US005189747A

United States Patent [19]

Mundy et al.

[11] Patent Number: 5,189,747

[45] Date of Patent: Mar. 2, 1993

[54] SEAT CUSHION

[75] Inventors: Philip C. Mundy; Jim E. Bender, both of Kitchener, Canada

[73] Assignee: Canadian Posture and Seating Centre (1988) Inc., Ontario, Canada

[21] Appl. No.: 770,903

[22] Filed: Oct. 4, 1991

[51] Int. Cl.[5] ..... A47C 27/18; A47C 7/02

[52] U.S. Cl. ..... 5/654; 5/653; 5/909; 24/30.5 S; 297/459

[58] Field of Search ..... 5/654, 653, 909, 464, 5/449, 457; 297/459, DIG. 1, DIG. 3; 24/30.5 S

[56] References Cited

U.S. PATENT DOCUMENTS

| | | | |
|---|---|---|---|
| 1,726,939 | 9/1929 | Anderson | 5/457 |
| 1,742,186 | 1/1930 | Claus | 5/462 |
| 3,987,507 | 10/1976 | Hall | 5/464 |
| 4,115,885 | 9/1978 | Davis | 5/654 |
| 4,370,769 | 2/1983 | Herzig et al. | 5/654 |
| 4,389,742 | 6/1983 | DeWitt | 5/654 |
| 4,629,246 | 12/1986 | Fulton | 5/653 |
| 4,726,624 | 2/1988 | Jay | 5/654 |
| 4,753,480 | 6/1988 | Morell | 5/653 |
| 4,796,948 | 1/1989 | Paul et al. | 5/654 |
| 4,837,881 | 6/1989 | Kondo et al. | 5/464 |
| 4,930,171 | 6/1990 | Frantz | 5/654 |

FOREIGN PATENT DOCUMENTS 3331689 3/1985 Fed. Rep. of Germany ..... 5/449

*Primary Examiner*—Alexander Grosz
*Attorney, Agent, or Firm*—R. Craig Armstrong

[57] ABSTRACT

A seat cushion is shown, of the type commonly used in conjunction with wheelchairs, but not necessarily limited to wheelchair seating. The seat cushion has a flat rigid base on which a shaped foam section with sides which angle outwardly and upwardly is supported. The foam section has a recessed area defined therein, to accommodate either a viscoelastic foam insert, or preferably a fluid-filled pad which is stuffed or accordion-folded into the recess. A suitable cover of two-way stretch moisture-proof fabric is provided. The fluid-filled pad is sealed peripherally along at least the front edge and both sides. The rear edge may also be permanently sealed, or may be provided with a variable position resealable closure extending across the rear end. At least one seam runs from the front edge to near the rear edge, to divide the pad into at least two and preferably three compartments. The seams do not run all the way to the rear, however, so that fluid may pass from compartment to compartment around the rear end of the seams, unless the rear is sealed across the seams.

8 Claims, 6 Drawing Sheets

SEAT CUSHION

BACKGROUND OF THE INVENTION

1. Field of the Invention

This invention relates generally to seat cushions, and particularly to seat cushions of the type commonly used in conjunction with wheelchairs.

The invention is not necessarily limited to wheelchair seating, as the cushions could be used in any desired seating application. However, the cushions are particularly useful in wheelchair seating, to reduce pressure exerted on the ischial tuberosities and sacral region, to prevent tissue trauma, and to reduce the probability of pressure sores, decubitis ulcers, and other well-documented problems associated with confinement to a wheelchair.

The preferred embodiment of the invention incorporates a pad which contains a viscous fluid.

2. Description of the Prior Art

Seat cushions incorporating fluid-filled pads are well known. See for example U.S. Pat. Nos. 4,588,229, 4,660,238, 4,726,624 and 4,761,843. In some such cushions, for example the ones described in U.S. Pat. Nos. 4,588,229 and 4,726,624, the pad is divided into compartments, each containing a fluid. The separate compartments are provided to prevent all of the fluid in the pad from flowing to one side such that the individual could "bottom out" on the seating platform. The pads are permanently sealed both peripherally and between compartments, so that there is no flow of fluid between the compartments, nor any possibility of adjusting the volume of fluid.

SUMMARY OF THE INVENTION

It is an object of the invention to provide a seat cushion assembly with various features which provide advantages over prior art cushions.

In the invention, the seat cushion has a flat rigid base on which a shaped foam section with sides which angle outwardly and upwardly is supported. The foam section has a recessed area defined therein, to accommodate either a visco-elastic foam insert, or preferably a fluid-filled pad which is stuffed or accordion-folded into the recess. A suitable cover of two-way stretch moisture-proof fabric is provided.

The fluid-filled pad is sealed peripherally along at least the front edge and both sides. The rear edge may also be permanently sealed, or may be provided with a variable position resealable closure extending across the rear end. At least one seam runs from the front edge to near the rear edge, to divide the pad into at least two and preferably three compartments. The seams do not run all the way to the rear, however, so that fluid may pass from compartment to compartment around the rear end of the seams, unless the rear is sealed across the seams.

Where a resealable closure is provided for the rear edge, selection of the distance of the resealable closure from the rear edge determines whether or not the rear seal passes over the seams, so that no flow between compartments is possible, or leaves a gap around the end of the seams so that flow between compartments is permitted. The resealable closure provides the additional advantage of adjustment of the volume of fluid in the cushion being possible.

In the preferred embodiment of the pad, there are two seams and thus three compartments, the middle compartment being wedge-shaped, broadening from front to rear. This configuration has been found to be particularly advantageous, by providing separate support for the sacral area and the ischial tuberosities.

If a resealable closure is used instead of a permanent seal, it is preferably a butyl rubber rod positionable across the rear edge. A C-shaped polyethylene clamp overrides the rod and sandwiches the pad between it and the rod to effect the seal.

Preferably, the fluid in the pad is a viscous gel, supplied by Canadian Posture and Seating Centre (1988) Inc., of Kitchener, Ontario, Canada, under its trademark LIQUISOF.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
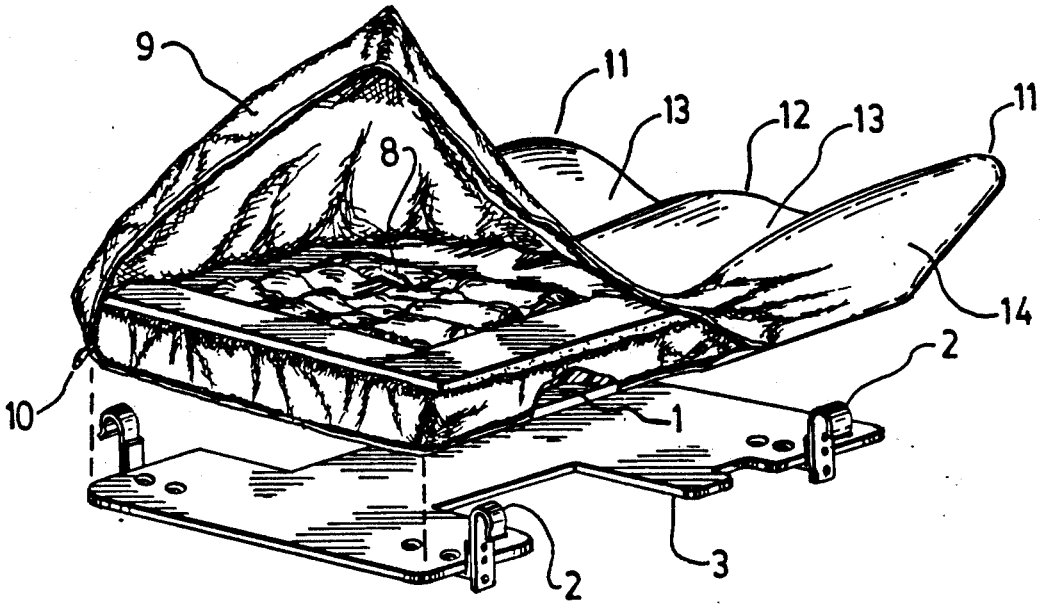
FIG. 1 is a perspective view of the cushion and the optional external platform, with the removable cover partially peeled back.
Figure 3:
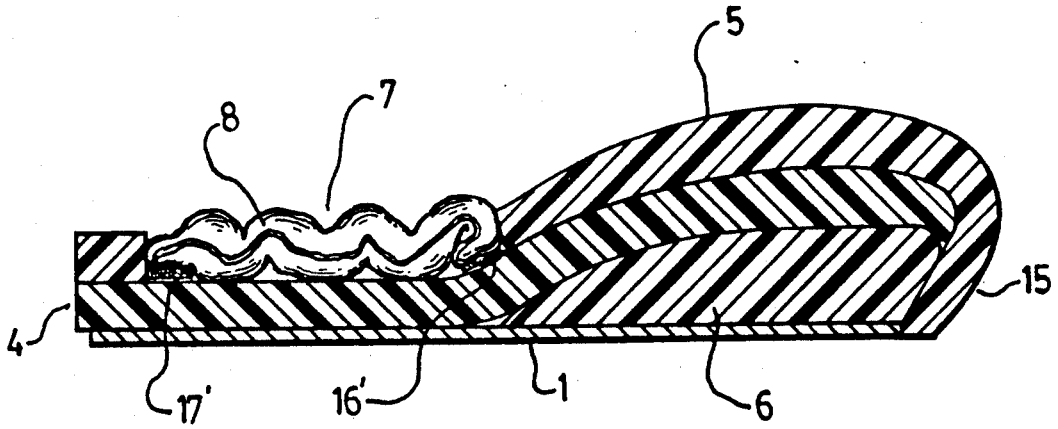
FIG. 3 is a cross-sectional view of the cushion at A—A in FIG. 2, with the cover removed.

Referring to the drawings, the seat cushion has an internal base 1, a lower layer 4 of polyurethane foam covering the base, an upper layer 5 of polyurethane foam over the lower layer, and more rigid ethylene-based shaped foam inserts 6 as required to provide the desired shaping Instead of separate foam layers being used, it should be readily appreciated that a single piece of molded or trimmed foam could be used.

The upper layer 5 has a rectangular area cut out therefrom, defining a recess 7 to accommodate either a visco-elastic foam insert (not specifically illustrated), or preferably a fluid-filled pad 8 which is stuffed or accordion-folded into the recess. The fluid-filled pad is preferred for most applications, but the visco-elastic foam insert is advantageous in some applications, particularly where a lighter overall cushion weight is desired.

If a visco-elastic pad is used instead of a fluid-filled pad, it is preferably a die-cut pad sized to fill the recess 7, made of a visco-elastic or slow return "memory foam" such as SUN-MATE or TEMPER FOAM (trademarks), both supplied by Dynamic Systems of Leicester, N.C., U.S.A.. Soft texture visco-elastic foam is the optimum choice as it creates an area which is less resistant to deformation than is the remainder of the seat cushion. This difference in "softness" or deformability allows more support or weight transfer to occur in areas other than in the area of the ischial tuberosities and sacrum which are then merely supported and cushioned.

The visco-elastic foam's low weight and superior (in comparison to high density polyurethane foam) shape enveloping characteristics, and its slow return properties, which decrease the amount of back or "counter pressure" exerted by the foam and transferred to the penetrator, make the visco-elastic insert a suitable temporary or permanent replacement for the gel pack when lower weight is a concern.

A removable cover 9, preferably of two-way stretch moisture-proof fabric on the top, and high denier moisture-proof nylon on the sides and bottom, is provided. It includes any suitable closure means such as a zipper 10, and covers the entire cushion, including the pad 8 and the internal base 1.

Figure 5:
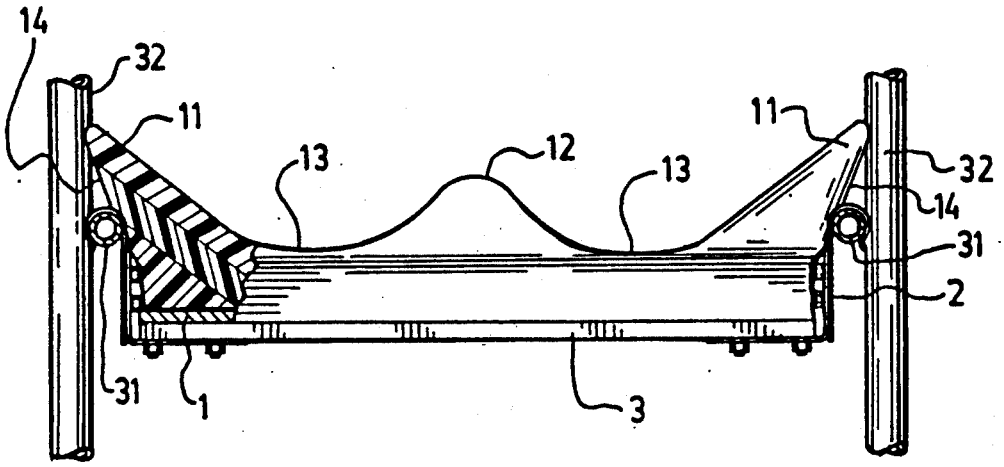
FIG. 5 is a front view of the cushion supported on the optional external platform.
Figure 11:
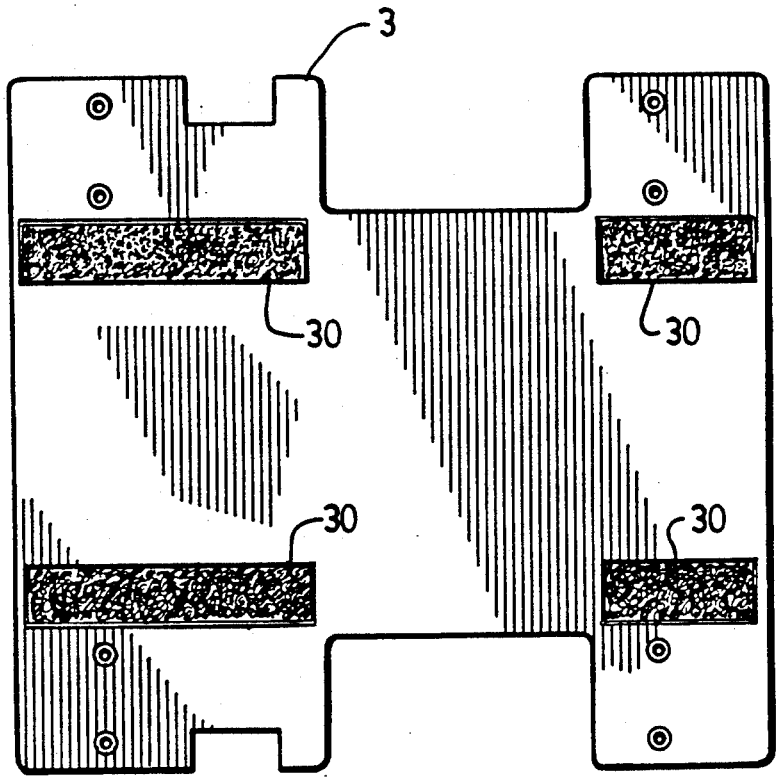
FIG. 11 is a plan view of the optional external platform.

The cushion may be placed directly onto the wheelchair seat or other support, since its internal base 1 provides it with sufficient structural strength where there is also some existing external support. Alternatively, as shown in FIG. 5, it may be supported on a platform or external base 3 which can be supported on the wheelchair frame members 31 by mounting clips 2. The mounting clips drop the platform down to compensate for the thickness of the cushion, so that the person is not sitting higher than intended for the wheelchair in question. The cushion may be secured to the platform 3 by Velcro (trademark) hook and pile strips 30 on the upper surface of the platform (see FIG. 11) and by corresponding strips on the underside of the cover (not shown).

Figure 2:
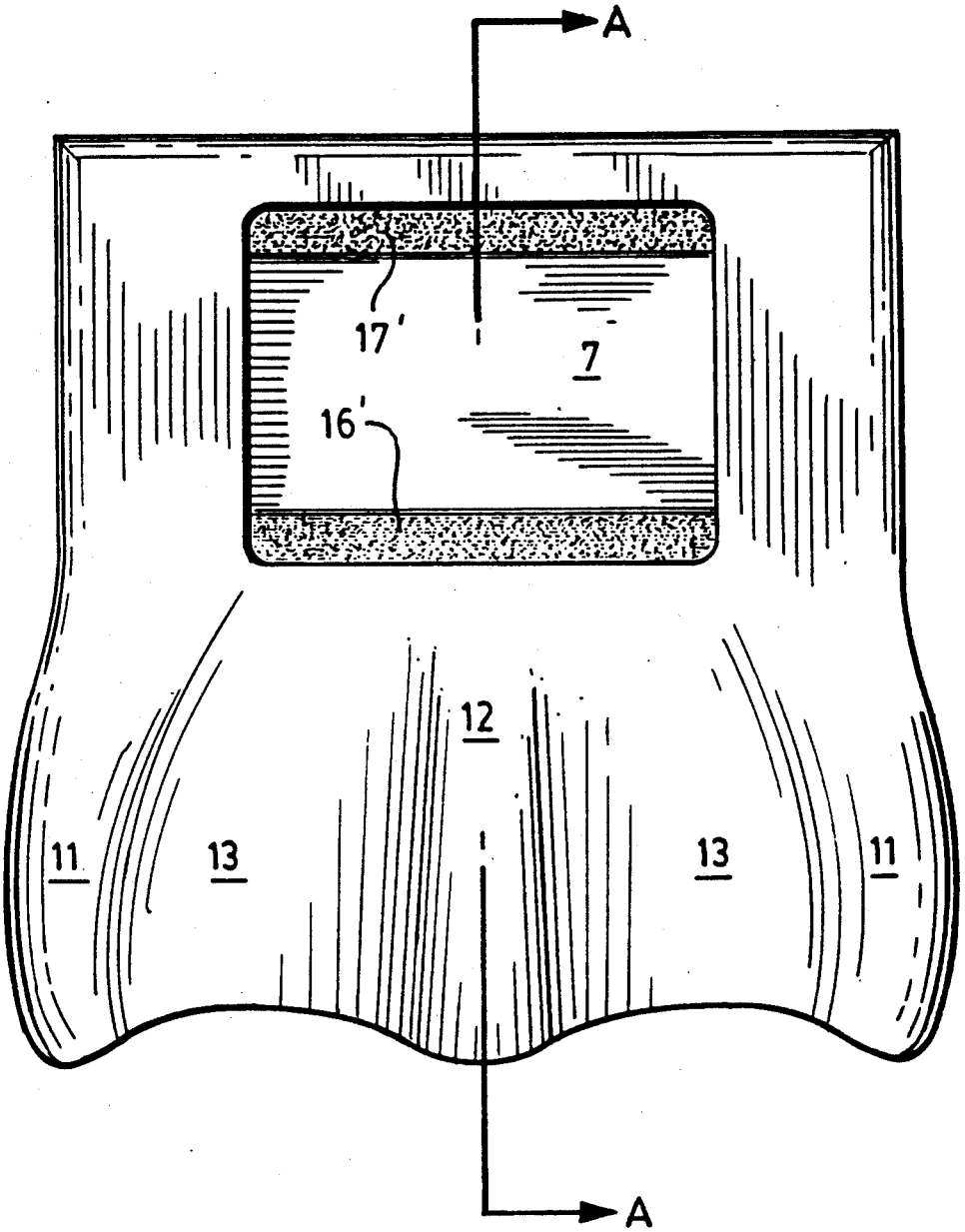
FIG. 2 is a plan view of the cushion, with the cover and pad removed.
Figure 4:
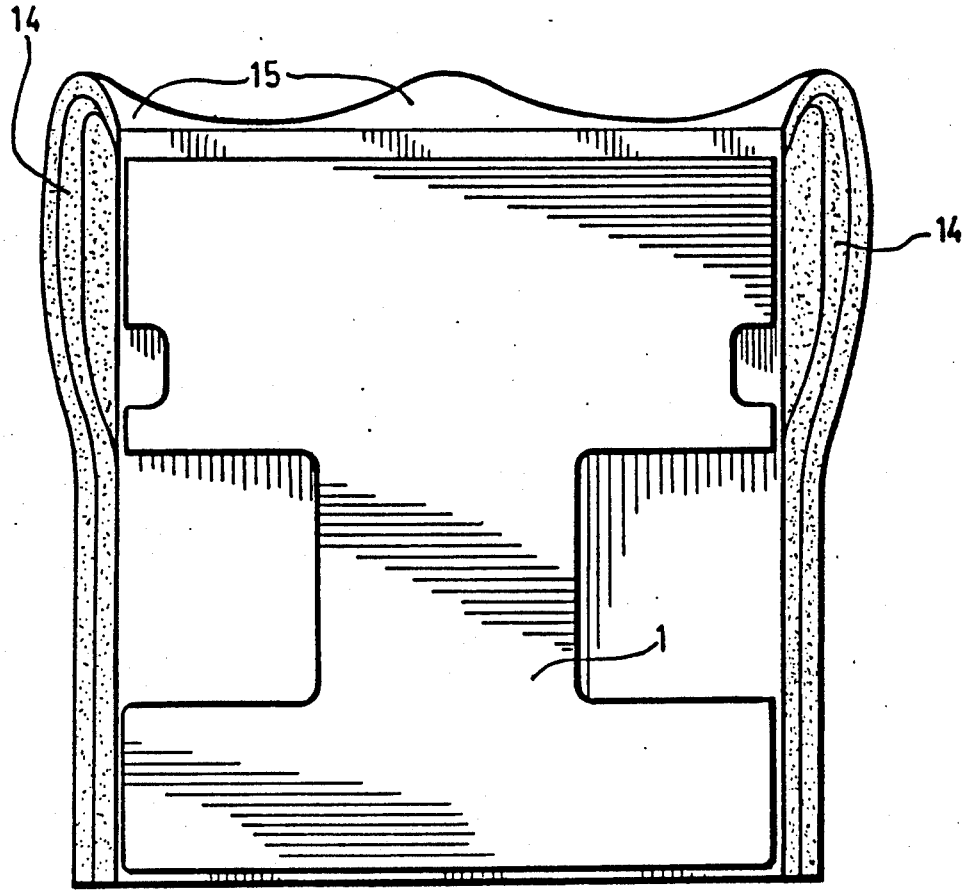
FIG. 4 is a bottom view of the cushion with the cover removed, showing the internal base.

As seen in FIGS. 1, 2 and 5, the cushion preferably is contoured by virtue of the shaped inserts 6, to fit and provide lateral support to a person's posterior and thigh areas, and thus has raised edges 11 and central portion 12, and depressed areas 13 near the front to accommodate the person's thighs. As seen in FIG. 5, the sides 14 angle outwardly at a substantial angle, e.g. 25 degrees from the vertical, so that the effective width of the cushion is considerably greater than the width of the internal base 1 and platform 3. This increases the utility of the cushion, since it may be accommodated in smaller wheelchair frames than would otherwise be the case, by ensuring that full use is made of the distance between the vertical frame members 32 and of the entire wheelchair seat width.

As can be seen from FIG. 2, the front edge 15 of the cushion is angled downwardly and rearwardly. This facilitates movement of the wheelchair by a user who has at least partial use of one or both legs, and who may wish to move the wheelchair by "walking" it. The angled front edge ensures minimum interference with the fore-and-aft range of motion of the legs.

The pad 8 may be filled with any suitable fluid, and many are described in the prior art. In the preferred embodiment, however, the fluid is a thixotropic gel supplied by Canadian Posture and Seating Centre (1988) Inc. of Kitchener, Ontario, Canada, under its trademark LIQUISOF. This gel is a mixture of Dow Corning's 200 Series polydimethylsiloxane (60,000 cst.) and Q4-2903 silastic gum, in ratios ranging from approximately 2:1 to 3:1. One of the properties of this gel is a high specific heat, so that it changes temperature very slowly. This is advantageous in that the person does not get hot for a relatively longer period of time, since it takes a longer period of time for the pad to reach body temperature.

The pad is preferably formed of two or three layers of 0.005 inch polyurethane, typically about 15×20 inches each. Two hook and loop type fastener, such as the one sold under the Trademark of Velcro strips 16 are attached to the upper surface of the pad adjacent the front border. Another pair of hook and loop type strips 17 are attached to the bottom surface of the pad near the rear of the pad.

The pad preferably has three layers rather than two, primarily for production reasons, since this permits thinner polyurethane to be used, for increased flexibility. If only two layers of thin polyurethane are used, the heat sealing of the edges may be prone to burn-through problems. Having three layers minimizes this problem and ensures a lower rate of production rejects. In the preferred embodiment, the gel material is inserted between the top and middle layers of the pad, although it could also be inserted between the bottom and middle layer.

Figure 6:
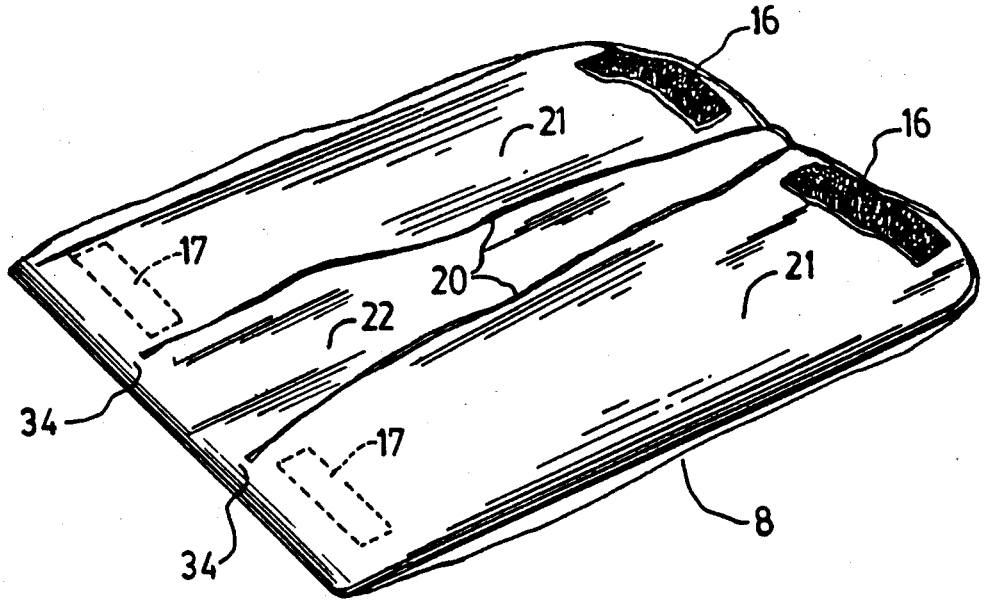
FIG. 6 is a perspective view of a fully-sealed pad.
Figure 7:
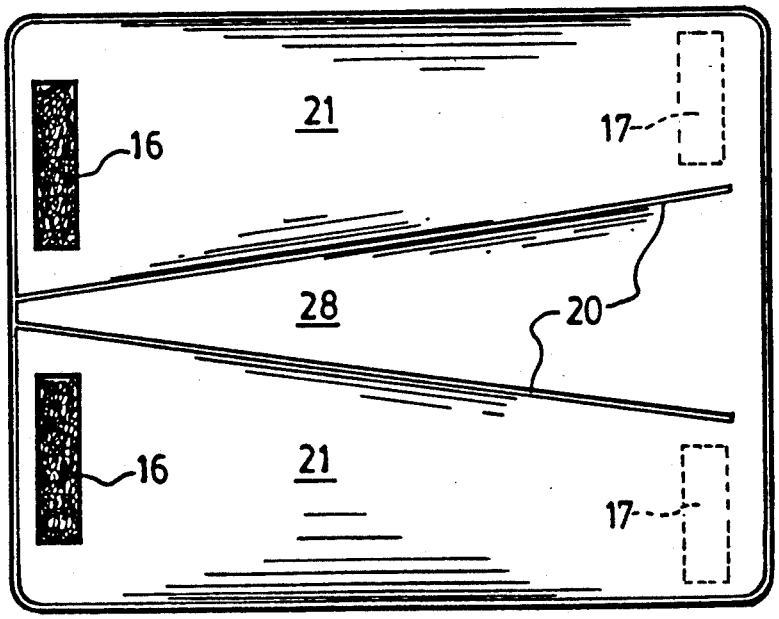
FIG. 7 is a plan view of the fully-sealed pad.
Figure 8:
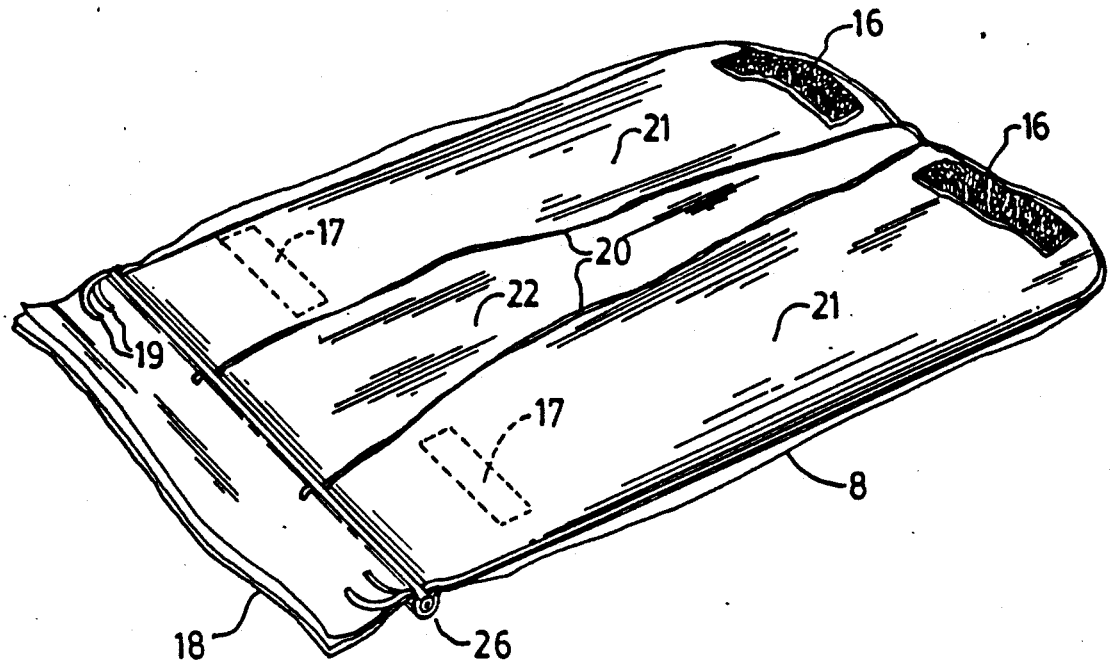
FIG. 8 is a perspective of an alternative embodiment of the pad, including a removable closure across the rear of the pad.
Figure 10:
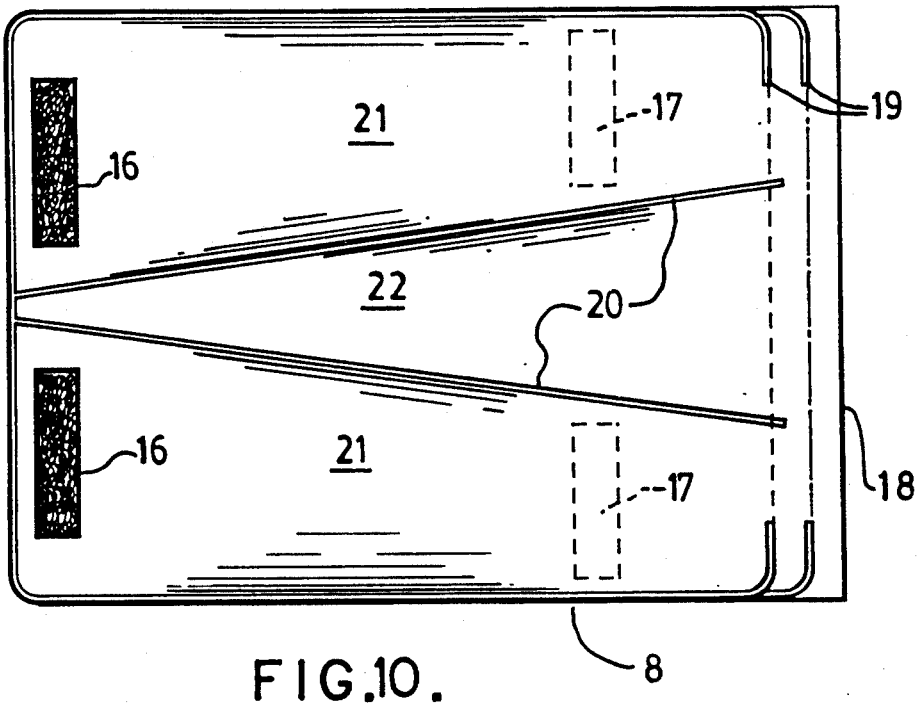
FIG. 10 is a plan view of the FIG. 8 version of the pad.

The perimeter of the pad is heat sealed along all four edges, as shown in FIGS. 6 and 7, or along only three of its four sides as shown in FIGS. 8 and 10, leaving the rear edge 18 open.

Referring to FIGS. 6 and 7, two heat-sealed seams 20 divide the pad into three generally tapered chambers, namely two outer chambers 21 and a central chamber 22. The seams each extend from the front edge of the pad towards the rear edge, preferably stopping a short distance from the rear edge, leaving small gaps 34 through which gel may migrate from one chamber to another.

Small clips identical in structure to the closure described below in connection with FIGS. 8 and 9, but much shorter, are used to seal off the gaps when desired.

Permitting migration of the gel through the gaps between chambers provides pressure equalization within self-balancing chambers and thereby supports and provides a "low shear zone" and flotation for the seated person's ischial tuberosities and sacral area. Preventing flow provides separate support of each ischial tuberosity and the sacral area of a person seated on the seat cushion. One useful strategy may be to allow the person to sit on the cushion for a day or two, with the chambers not sealed with respect to each other, and then use the clips to seal off the chambers from each other once an equilibrium has been reached.

Figure 9:
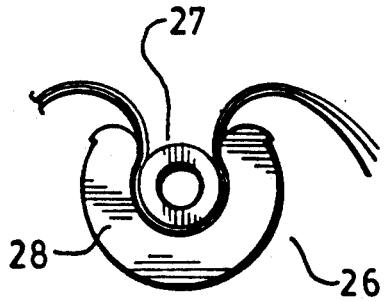
FIG. 9 is a cross-section of the removable closure.

In the alternative embodiment of the pad shown in FIGS. 8–10, the rear edge is not sealed. Two short heat-sealed seams 19 extend in parallel inwardly for an inch or two from both heat-sealed side edges at points near the rear edge of the pad. The seams 20 which separate the compartments each extend from the front edge of the pad towards the rear edge, stopping approximately just forward of an imaginary line between the two short seams 19. The open rear edge of the pad is sealed by a removable closure 26, consisting of a tube 27 and a C-shaped clip 28, both of which run the full width of the rear edge. Referring to FIGS. 8 and 9, the open rear edge of the pad is folded around the tube 27, and the clip 28 is positioned around the tube so that the rear edge of the pad is sandwiched between the tube and the clip and thereby sealed. The tube must be positioned forward of the short seams 19, so that none of the fluid can escape.

If the closure is positioned such that the pad is sealed at a point rearward of the ends of the pad's two diagonal seams, the fluid can flow around the ends of the seams between the three chambers. If positioned across the seams, the chambers will be sealed from each other.

The fact that the closure is removable permits not only this repositioning to permit or prevent flow between chambers, but also permits the volume of viscous material which fills the pad to be readily adjustable.

The pad is stuffed or accordion-folded into the recess 7 such that hook and loop type tabs 16 and 17 mate with corresponding tabs 16' and 17' within the recess.

It will be appreciated that the above description relates to the preferred embodiment by way of example only. Many variations on the invention will be obvious to those knowledgeable in the field, and such obvious variations are within the scope of the invention as described and claimed, whether or not expressly described.

What is claimed as the invention is:

1. A seat cushion comprising:

a base having lower and upper surfaces and front, rear and side edges;

a shaped foam cushioning element secured across the upper surface of said base, having a generally rectangular recess in the upper surface thereof defining an insert area, said insert area being near the rear of the cushioning element and being generally centered from side to side; and a generally rectangular pad positionable in said insert area, substantially filling said insert area, said pad containing a viscous gel between at least two layers of plastic defining an envelope for said gel, said pad being sealed around front, rear and two side edges thereof and being divided by two seams into three separate and distinct compartments each of comparable volume, namely a central compartment adapted to support the sacral area of a user, and two side compartments adapted to support the ischial tuberosities of a user, each seam having a small gap at some point therealong to permit minimal flow of said gel between said compartments.

2. A seat cushion as recited in claim 1, in which said insert area extends only part of the way towards said base from said upper surface of said foam cushioning element, such that a layer of said foam cushioning element remain below said insert area, such that said seat cushion has said pad positioned above a layer of foam, so that even if gel migrates away from a particular area of the pad, a person sitting on the cushion is still supported on at least said layer of foam below said insert area.

3. A seat cushion as recited in claim 2, said cushioning element having sides which angle outwardly from the area of said base at an angle generally in excess of about 15 degrees, thereby providing a large effective seating area.

4. A seat cushion as recited in claim 3, further comprising a removable fabric cover surrounding said base, said foam cushioning element, and said pad.

5. A seat cushion as recited in claim 2, further comprising a removable fabric cover surrounding said base, said foam cushioning element, and said pad.

6. A seat cushion as recited in claim 1, said cushioning element having sides which angle outwardly from the area of said base at an angle generally in excess of about 15 degrees, thereby providing a large effective seating area.

7. A seat cushion as recited in claim 6, further comprising a removable fabric cover surrounding said base, said foam cushioning element, and said pad.

8. A seat cushion as recited in claim 1, further comprising a removable fabric cover surrounding said base, said foam cushioning element, and said pad.

* * * * *